US010189622B2

(12) United States Patent
Scrivani et al.

(10) Patent No.: US 10,189,622 B2
(45) Date of Patent: Jan. 29, 2019

(54) PACK OF SINGLE USE CAPSULE OR POD, PACKAGING MACHINE AND METHOD THEREOF

(71) Applicant: AZIONARIA COSTRUZIONI MACCHINE AUTOMATICHE A.C.M.A. S.p.A., Bologna (IT)

(72) Inventors: Massimo Scrivani, Casteggio (IT); Mario Spatafora, Granarolo Dell'Emilia (IT)

(73) Assignee: AZIONARIA COSTRUZIONI MACCHINE AUTOMATICHE A.C.M.A. S.P.A. (IT)

( * ) Notice: Subject to any disclaimer, the term of this patent is extended or adjusted under 35 U.S.C. 154(b) by 0 days.

(21) Appl. No.: 15/029,156

(22) PCT Filed: Oct. 17, 2014

(86) PCT No.: PCT/IB2014/065422
§ 371 (c)(1),
(2) Date: Apr. 13, 2016

(87) PCT Pub. No.: WO2015/056240
PCT Pub. Date: Apr. 23, 2015

(65) Prior Publication Data

US 2016/0236842 A1 Aug. 18, 2016

(30) Foreign Application Priority Data

Oct. 17, 2013 (IT) ..... BO2013A0573

(51) Int. Cl.
*B65D 75/04* (2006.01)
*B65D 77/00* (2006.01)
(Continued)

(52) U.S. Cl.
CPC ..... *B65D 75/04* (2013.01); *B65B 29/02* (2013.01); *B65B 31/00* (2013.01); *B65B 35/10* (2013.01);
(Continued)

(58) Field of Classification Search
CPC .. B85D 85/8043; B65D 75/04; B65D 77/003; B65D 81/2069; B65B 29/02; B65B 31/00; B65B 43/42
See application file for complete search history.

(56) References Cited

U.S. PATENT DOCUMENTS 4,560,475 A * 12/1985 Kataoka ..... B65D 85/8043 210/249
5,406,776 A 4/1995 Cappi et al.
(Continued)

FOREIGN PATENT DOCUMENTS

DE 1915044 U 4/1965
EP 0391712 A1 10/1990
(Continued)

OTHER PUBLICATIONS

International Search Report dated Jan. 16, 2015 from PCT App No. PCT/IB2014/065422.
(Continued)

*Primary Examiner* — Erik Kashnikow
*Assistant Examiner* — Chaim A Smith
(74) *Attorney, Agent, or Firm* — Shuttleworth & Ingersoll, PLC; Timothy J. Klima

(57) ABSTRACT

A pack including at least one single-use capsule or pod for a portioned beverage which has two opposite bases, and a side wall connecting the two bases defining therewith a chamber for containing an aromatic substance; the pack has a sealed container for containing the capsule or pod housed in a protective inert gas atmosphere; more specifically the
(Continued)

sealed container copies at least in part the shape of the capsule or pod.

19 Claims, 4 Drawing Sheets

(51) Int. Cl.

| | |
|---|---|
| ***B65D 81/20*** | (2006.01) |
| ***B65D 85/804*** | (2006.01) |
| ***B65B 29/02*** | (2006.01) |
| ***B65B 31/00*** | (2006.01) |
| ***B65B 35/10*** | (2006.01) |
| ***B65B 43/42*** | (2006.01) |

(52) U.S. Cl.
CPC ..... *B65B 43/42* (2013.01); *B65D 77/003* (2013.01); *B65D 81/2069* (2013.01); *B65D 85/8043* (2013.01)

(56) References Cited

U.S. PATENT DOCUMENTS 5,842,408 A * 12/1998 Hatta ..... A47J 31/02 210/474
2007/0062375 A1* 3/2007 Liverani ..... B65D 85/8043 99/279
2013/0025466 A1* 1/2013 Fu ..... A47J 31/08 99/295
2013/0309364 A1* 11/2013 Gerbaulet ..... A47J 31/22 426/84
2014/0023754 A1* 1/2014 Abegglen ..... A47J 31/22 426/112
2015/0158609 A1* 6/2015 Villain ..... B65B 29/02 426/112

FOREIGN PATENT DOCUMENTS

| | | | |
|---|---|---|---|
| FR | 2846640 | A1 | 5/2004 |
| JP | H06286730 | A | 10/1994 |
| JP | 2004238005 | A | 8/2004 |
| WO | WO2011039711 | A1 | 4/2011 |

OTHER PUBLICATIONS

English translation of Japanese Office Action dated Sep. 28, 2017 for counterpart Japanese Patent Application No. 2016-524007.
English translation of Japanese Office Action dated Jan. 30, 2018 for counterpart Japanese Patent Application No. 2016-524007.

* cited by examiner

PACK OF SINGLE USE CAPSULE OR POD, PACKAGING MACHINE AND METHOD THEREOF

This application is the National Phase of International Application PCT/IB2014/065422 filed Oct. 17, 2014 which designated the U.S. and that International Application was published under PCT Article 21 (2)in English.

This application claims priority to Italian Patent Application No. BO2013A000573 filed Oct. 17, 2013, which application is incorporated by reference herein.

TECHNICAL FIELD

This invention relates to a pack of a single-use capsule or pod and a machine and method for packaging single-use capsules or pods.

More specifically, this invention relates to a pack comprising a container containing a single-use capsule or pod for a portioned beverage, and to a machine and a method for packaging single-use capsules or pods for portioned beverages.

BACKGROUND ART

In the vertical packaging machines of known type a suitable forming device creates, with a sheet starting from a strip, a vertical tube subjected to transversal sealing at predetermined spacing.

After making a transversal seal which closes a section of the tube, the product to be packaged is introduced by gravity into the tube before performing the subsequent transversal sealing.

The tube is then cut transversely at the transversal sealing zones to detach the pack from the tube.

These vertical packaging machines require a considerable use of packaging material since, to prevent the product to be packaged from becoming stuck in the tube whilst it is being lowered, the tube must have a diameter greater than the maximum outside dimension of the product.

The diameter of the tube is also over-sized to allow the escape of air which could otherwise become trapped between the falling product and the cross section of the tube closed by the transversal sealing.

There are also horizontal forming, filling and sealing packaging machines (in jargon called "Form, fill and seal" or "flow pack"), commonly used in the sector of packaging capsules for portioned beverages, particularly coffee capsules.

In these packaging machines a tubular sheet is positioned horizontally and the capsules are simply rested inside it at predetermined reference positions.

In this case, to create a pack wherein the container contains the capsule immersed in an atmosphere of protective inert gas, the tube is subjected to transversal sealing at predetermined spacing whilst a flow of inert gas passes through which fills it whilst expelling at the same time the atmospheric air contained.

To prevent the capsules from moving from their correct reference position during the flow of gas, an over-sizing of the diameter of the tube is necessary, to eliminate the possible occurrence of excessive overpressures inside the tube due to the obstacle created by the capsules to the circulation of the gas.

This embodiment for the capsule making machine also determines a considerable waste of packaging material which, as in the case described above, has a negative effect on the cost of the pack.

As well as the considerable waste of packaging material there is an equally significant waste of inert protective gas necessary for filling the more voluminous packs.

These packs, because of how they are made, therefore have an overall size which is considerably greater than the size of the capsule which they contain.

This also adversely affects the logistics as very containers are required for arranging a predetermined number of packs, with obvious negative repercussions on the storage and transport costs.

DISCLOSURE OF THE INVENTION

The technical purpose this invention proposes to accomplish is therefore to provide a pack comprising a container containing a capsule or pod for a portioned beverage, a machine and a method for packaging capsules or pods which allow the above-mentioned technical drawbacks of the prior art to be overcome.

In the context of this technical purpose, one aim of the invention is to provide a machine and a method for packaging capsules or pods for portioned beverages which allow a saving in the quantity of material used for packaging the capsules.

Another aim of the invention is to provide a machine and a method for packaging capsules or pods for portioned beverages which allow a saving in the quantity of protective gas used for filling the containers.

Another aim of the invention is to provide a machine and a method for packaging capsules or pods for portioned beverages which allow extremely compact packs to be made.

Yet another aim of the invention is to provide a machine and a method for packaging capsules or pods for portioned beverages which allow the logistics for storage and transport of the packed capsules or pods obtained in this way to be simplified.

The technical purpose, as well as these and other aims, are achieved by providing a pack comprising a single-use capsule or pod according to the present disclosure, a machine for automatic continuous packaging of the single-use capsules or pods according to the present disclosure, and a method for automatic continuous packaging of single-use capsules according to the present disclosure.

Advantageously, the invention comprises a tight packaging of the capsule or pod in the container which therefore has a larger surface of contact with the a capsule or pod.

Since at the surface of contact the container adopts the shape of the capsule or pod, it is possible to use these surfaces of contact as references to place the packs in a container in an ordered manner in such a way as to optimise the occupation of its inner space.

BRIEF DESCRIPTION OF THE DRAWINGS

Further features and advantages of the invention are more apparent in the detailed description set out below of a preferred, non-limiting embodiment of the pack of capsules or pods for portioned beverages, and of the machine and the method for packaging capsules or pods for portioned beverages, according to the invention, as illustrated in the accompanying drawings, in which.

DETAILED DESCRIPTION OF PREFERRED EMBODIMENTS OF THE INVENTION

Figure 1:
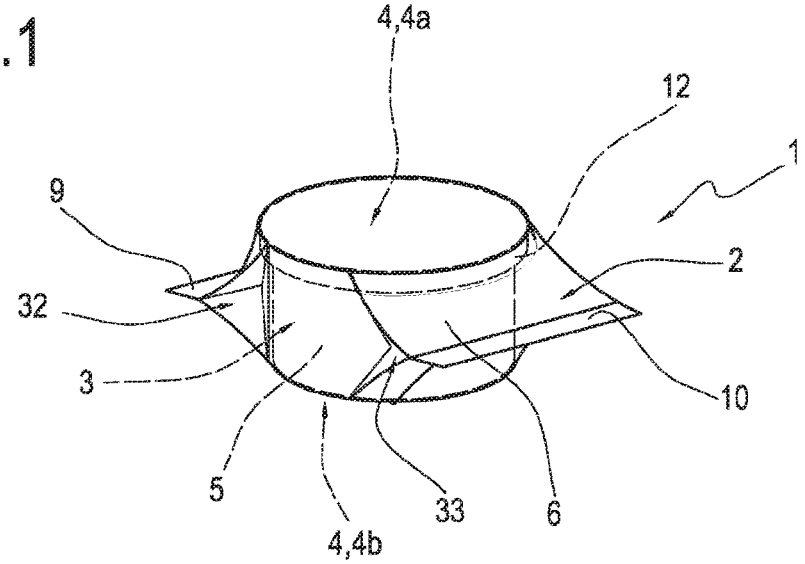
FIG. 1 shows a perspective view of a pack of a capsule according to a preferred embodiment of the invention.
Figure 2:
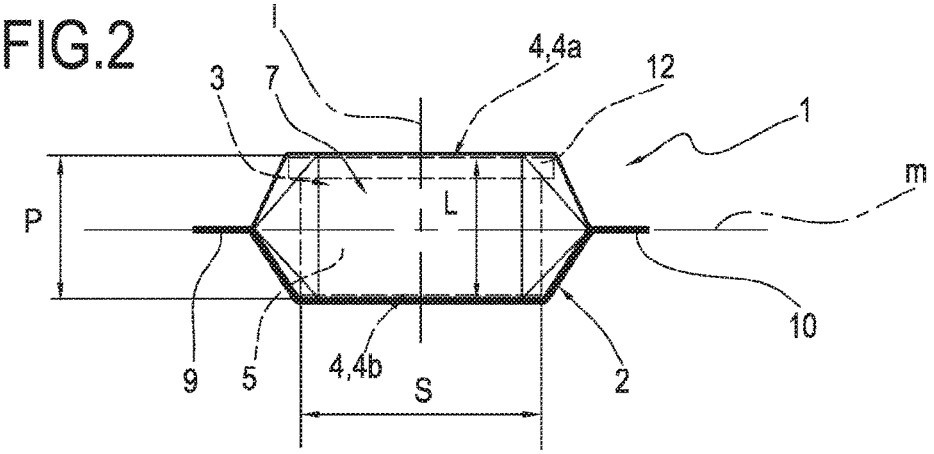
FIG. 2 shows a schematic side view of the pack of FIG. 1, with some parts cut away to better illustrate others.
Figure 3:
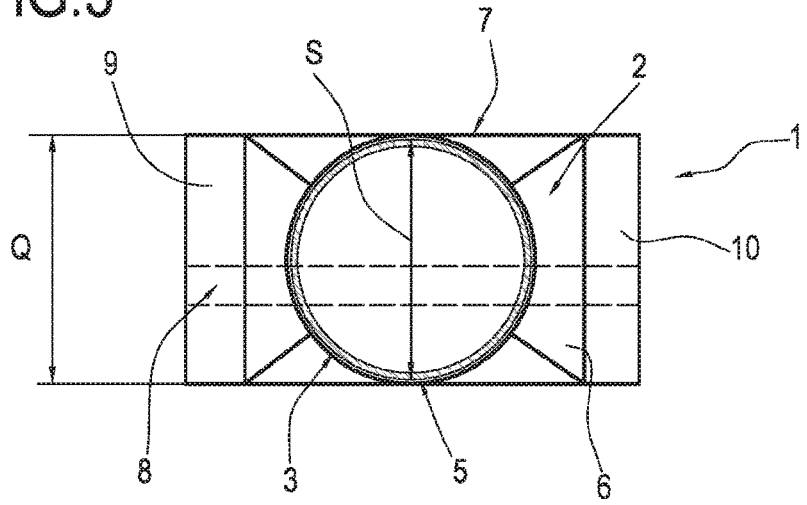
FIG. 3 shows a plan view of the pack of FIG. 1, wherein the container is shown in longitudinal cross section.

The accompanying drawings show a pack 1 comprising a sealed container 2 containing an atmosphere of protective inert gas, for example, nitrogen, which houses a capsule 3 for a portioned beverage.

The field of application of the invention extends to capsules or pods for portioned beverages in any sector of the food industry, especially but not necessarily for the coffee industry, and to capsules or pods having any configuration.

The capsule or pod has, for example, the form of a solid of rotation.

The capsule or pod has, for example, the form of a prism.

The capsule or pod has, for example, a truncated cone shape.

The capsule or pod has, for example, a cylindrical shape.

More specifically, the capsule 3 has in the direction of the relative axis "I" a height which is delimited by two bases 4, 4 opposite each other and in a direction transversal to the relative axis "I" a width delimited by a side wall 5.

The side wall 5 connects the two bases 4, 4 and delimits with them a chamber for containing an aromatic substance, for example coffee.

More specifically, the two opposite bases 4, 4 comprise an upper base 4*a* and a lower base 4*b*.

Preferably, the bases 4, 4 of the capsule 3 are flat and parallel and the side wall 5 of the capsule 3 is cylindrical.

At a base 4 of the capsule 3 there is preferably also an outer annular perimeter flange 12.

The container 2 is formed by a single or multi-ply flexible sheet 6. The container is configured in such a way as to form a tubular body 7.

A longitudinal tab 8 formed by two longitudinal flaps of the sheet 6 superposed and sealed to each other extends externally from the tubular body 7.

The sheet 6 comprises at least one layer of aluminium having a barrier effect for the oxygen and the other external contaminants.

The longitudinal axis of the tubular body 7 will hereafter be referred to with the label "m".

The tubular body 7 is closed at its axial ends 9, 10 by suitable end seals.

The capsule 3 is positioned in the container 2 with the relative axis "I" oriented at right angles to the longitudinal axis "m" of the tubular body 7.

According to a particularly advantageous aspect of the invention, the maximum internal height "P" of the tubular body 7 in the direction of the axis "I" of the capsule 3 is equal to the maximum external height "L" of the capsule 3.

Preferably, also, the maximum internal width "Q" of the tubular body 7 is equal to the maximum external width "S" of the capsule 3.

In the case illustrated wherein the bases 4, 4 of the capsule 3 are flat and parallel, the tubular body 7 is in contact with the entire external surface of the bases 4, 4.

The tubular body 6 therefore has large surfaces of contact with the capsule 3, which extend in particular at least for the entire external surface of both the bases 4, 4 of the capsule 3.

As already indicated, the capsule 3 may have a variable height in the direction of the width and also a variable width in the direction of the height.

In any case, the tight wrapping of the container 2 around the capsule 3 such that the majority of the inner surface of the container 2 is in contact with the outer surface of the capsule 3 determines for the pack 1 a reduced value of the ratio between the free inner volume of the container 2 and the total inner volume of the container 2, together with a reduced value of the ratio between the outer surface of the capsule 3 and the surface area of the sheet which forms the container 2.

In the pack 1 thus configured, the external surface of the container 2 is substantially equal to twice the external surface of the capsule 3.

In this way, the pack 1 achieves an appreciable saving both of the material constituting the container 2 and of the protective filler gas.

Obviously, for an automatic continuous packaging machine which must guarantee a certain hourly production, the overall daily cost saving for the packaging the capsules or pods becomes considerable.

Advantageously, the sealed container 2 copies at least in part the shape of the capsule or pod 3.

The term "copies" means reproducing or replicating the shape of the capsule or kind 3.

This is possible as the sealed container 2 is positioned around the capsule 3 at a distance such as to define a gap having a size such as not to allow a free movement of the pod 3*c* inside the sealed container 2.

The sealed container 2 is in contact with at least part of the capsule or pod 3 to at least partly reproduce the shape thereof.

In an alternative embodiment, the term "contact" means that the sealed container 2 is in close contact with the a capsule or pod 3

More specifically, the sealed container 2 is in contact with at least part of at least one of the two bases 4 of the capsule or pod 3.

In this embodiment, the sealed container 2 is in contact with both of the two bases 4 of the capsule or pod 3.

More specifically, the sealed container 2 is in contact with the entire outside surface of at least one of the two bases 4, 4.

The sealed container 2 is also in contact with at least part of the side wall 5 of the capsule or pod 3.

The sealed container 2 surrounds the capsule or pod 3.

The term "surrounds" means that the sealed container 2, which is substantially polygonal in shape, is tangential at several points to the capsule or pod 3, which is substantially cylindrical in shape.

The overall dimensions of the pack 1 may be reduced to a minimum size wherein the tab 8 and the ends 9, 10 are folded against the tubular body 7.

With such compact packs, the storage and transport logistics are optimised, as the same space can house a greater number of packs.

The machine for automatic continuous packaging of the capsules has means for conveying the capsules in sequence through various operating stations.

The conveyor means comprise, for example, transfer wheels 13 equipped peripherally with a plurality of gripping elements or grippers 14 each designed to grip, retain and release a corresponding capsule 3.

The transfer wheel 13*a* comprising a plurality of gripper elements 14, in particular jaws 14, hinged to the transfer wheel 13*a* in pairs.

The gripper elements 14 hold a respective capsule or pod 3 by its side wall 5 wrapped in the respective sheet 6.

The operating stations comprise in sequence a station (not illustrated) for feeding the capsules 3, a station (not illustrated) for cutting and measuring sheets 6 and depositing them on the capsules 3, a station (not illustrated) for tight wrapping of the sheets 6 around the capsules 3 and sealing the abutting longitudinal flaps of the sheets 6, and a station 15 for shaping the ends of the tubular bodies 7 obtained from the sealing of the abutting longitudinal flaps of the sheets 6, flowing of the inert gas through the tubular bodies 7, and sealing for the closing of the axial ends of the tubular bodies 7.

In other words, at the shaping station 15 a flexible sheet 6 is modelled about at least one capsule or pod 3 to copy at least in part the shape of the capsule or pod 3.

Figure 4:
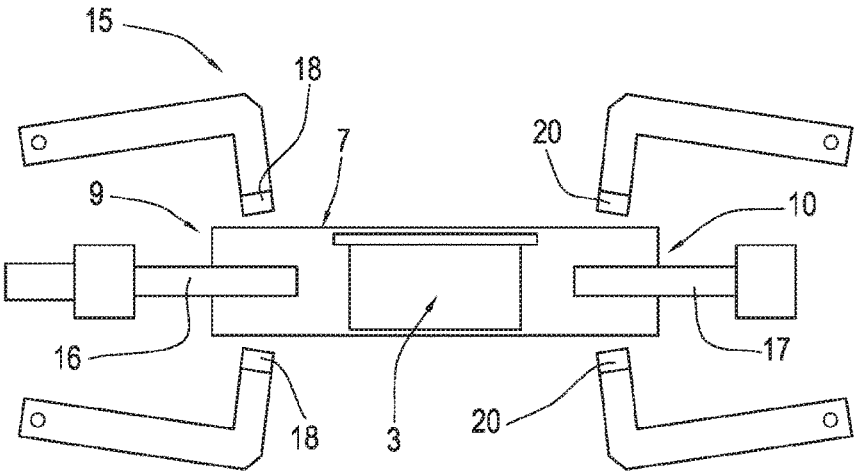
FIG. 4 shows a detail of an integrated station of the machine according to a preferred embodiment, with some parts cut away for clarity, in a first operating step.

More specifically, FIG. 4 shows a detail of the shaping station 15 or integrated station of the machine where, in use, the container wrapped around the capsule is filled with the protective gas and closed, in the configuration in which the duct for feeding the inert gas and the duct for extracting the air are introduced into the respective axial end of the tubular body, the means for sealing the axial ends of the tubular body are in an inactive position, whilst the grippers for picking up the capsule and the means for shaping the axial ends of the tubular body are, for clarity, not illustrated.

Figure 5:
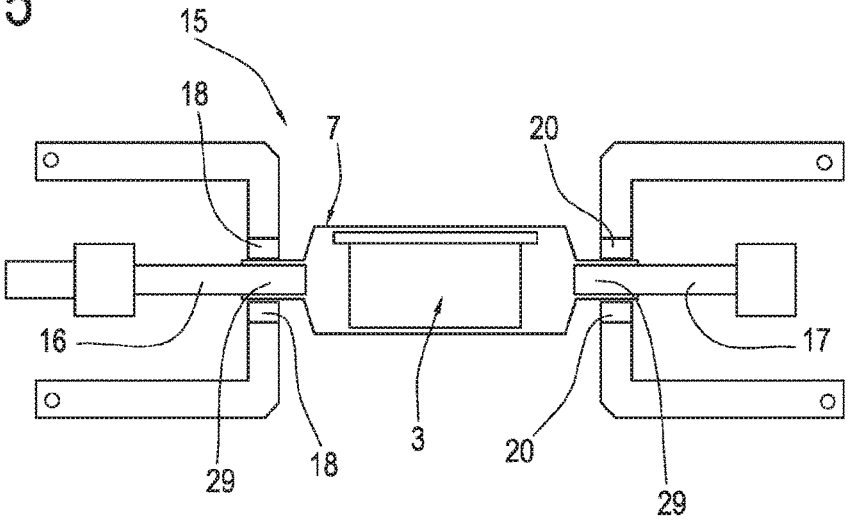
FIG. 5 shows the same detail of FIG. 4 of the integrated station of the machine according to a preferred embodiment in a relative second operating step.

Moreover, FIG. 5 shows a detail of the integrated station where the container wrapped around the capsule is filled with the protective gas and closed, in the configuration in which the duct for feeding the inert gas and the duct for extracting the air are introduced into the respective axial end of the tubular body, the means for sealing the axial ends of the tubular body are rested against opposite sides of the perimeter of the axial ends of the tubular body, whilst the grippers for picking up the capsule and the means for shaping the axial ends of the tubular body are, for clarity, not illustrated.

Figure 6:
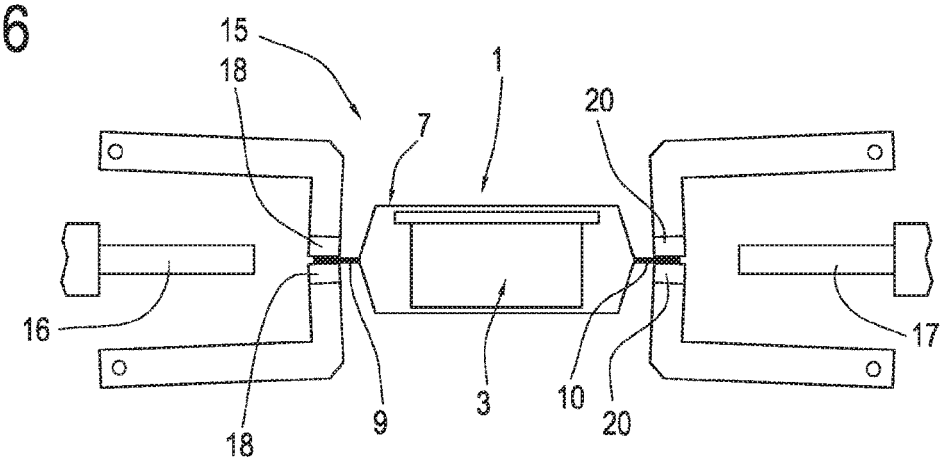
FIG. 6 shows the same detail of FIGS. 4 and 5 of the integrated station of the machine according to a preferred embodiment in a relative third operating step.
Figure 7:
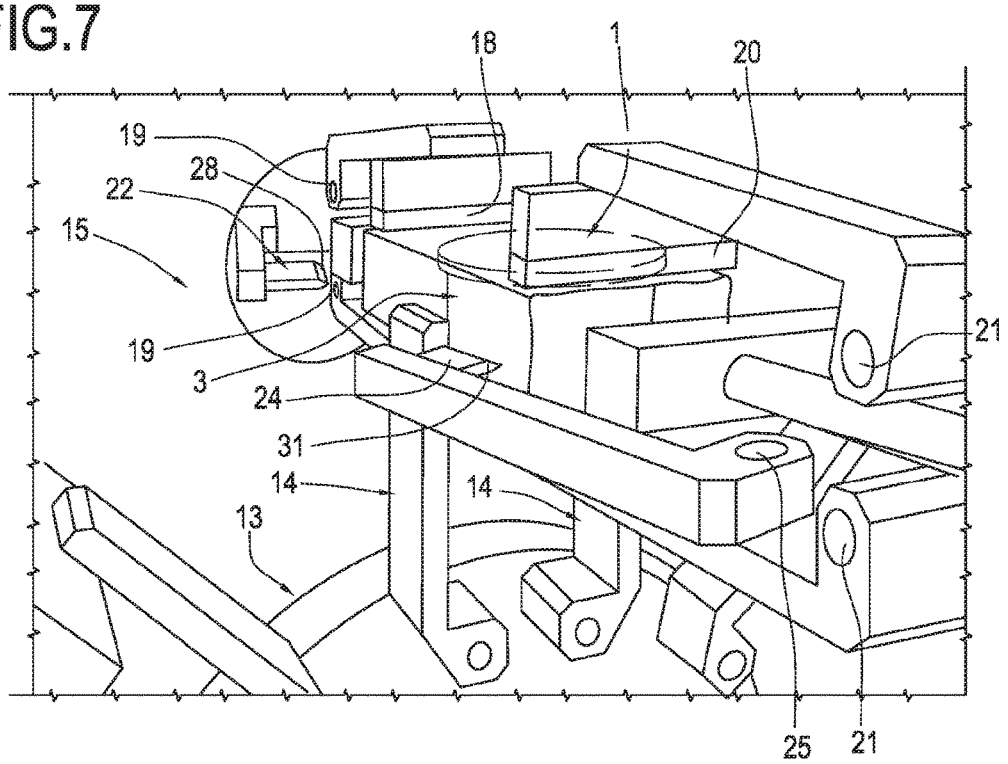
FIG. 7 shows a perspective view of a detail of the integrated station where the container wrapped around the capsule is filled with the protective gas and closed, in the same configuration of FIG. 4 and with the means of shaping the axial ends of the tubular body in inactive position.
Figure 8:
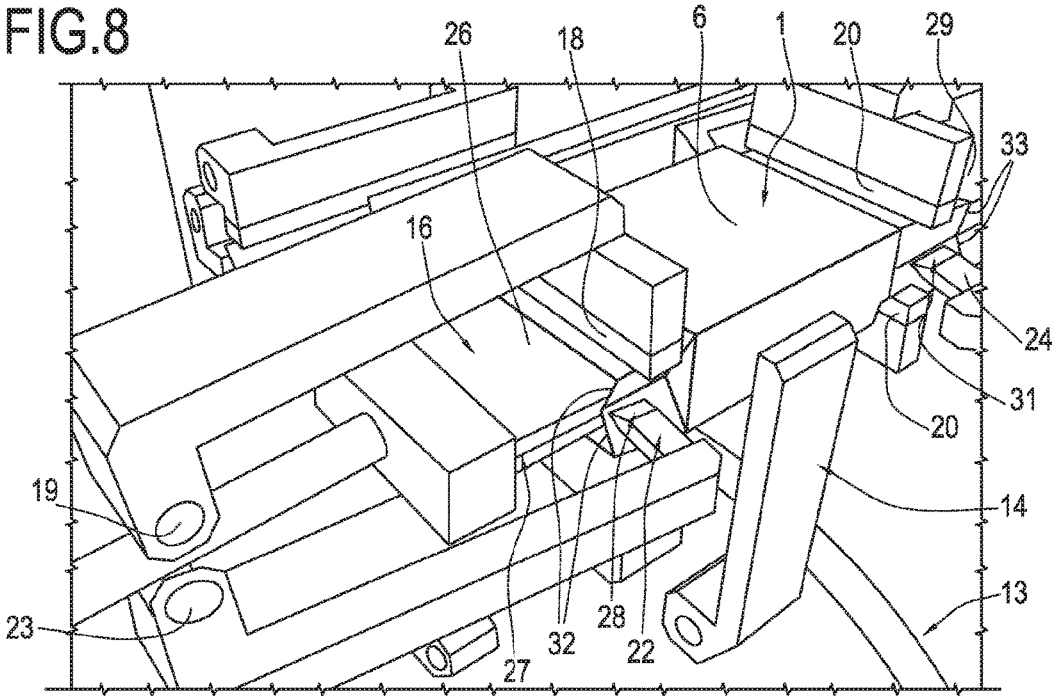
FIG. 8 shows a perspective view of a detail of the integrated station where the container wrapped around the capsule is filled with the protective gas and closed, with the sealing means and the shaping means the axial rested against the perimeter of the axial ends of the tubular body.
Figure 9:
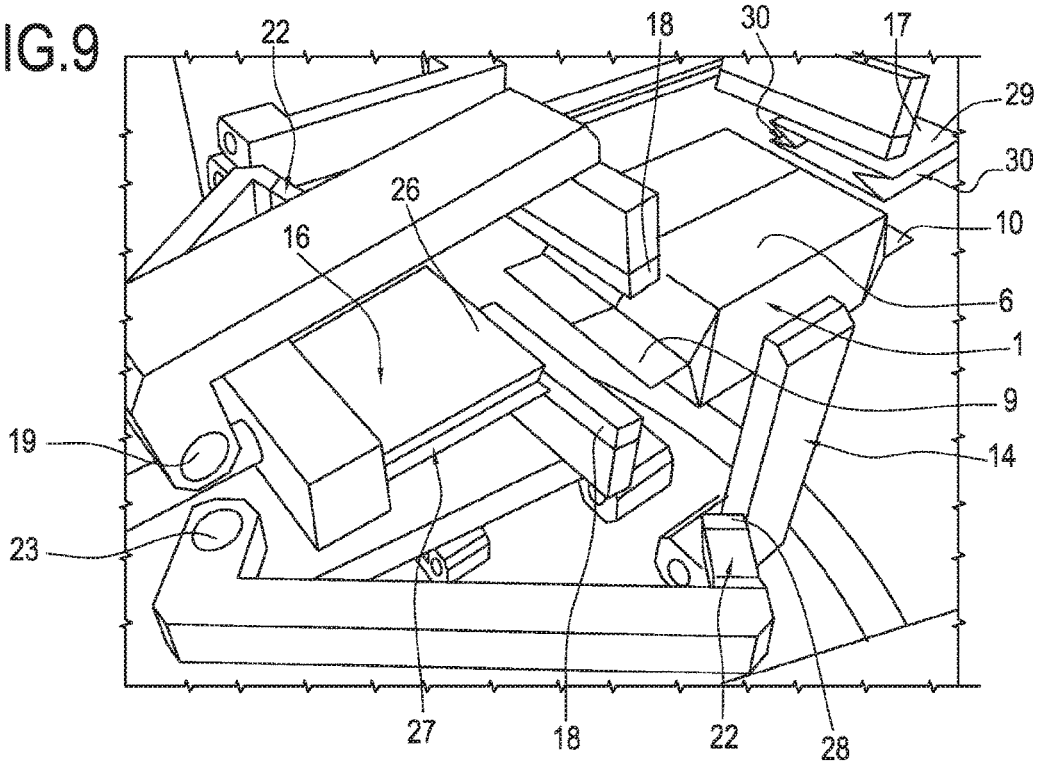
FIG. 9 shows a perspective view of a detail of the integrated station where the container wrapped around the capsule is filled with the protective gas and closed, at the end of the packaging of the capsule.

Lastly, FIG. 6 shows a detail of the integrated station where the container wrapped around the capsule is filled with the protective gas and closed, in the configuration in which the duct for feeding the inert gas and the duct for extracting the air are withdrawn from the respective axial end of the tubular body, the means for sealing the axial ends of the tubular body are in sealing position, whilst the grippers for picking up the capsule and the means for shaping the axial ends of the tubular body are, for clarity, not illustrated.

As illustrated in the accompanying drawings, the station 15 comprises a duct 16 for feeding inert gas, which is movable in the direction of the axis "m" of the tubular body for being introduced and extracted from the first open axial end 9 of the tubular body 7, and a duct 17 for extracting air, which is movable in the direction of the axis "m" of the tubular body for being introduced and extracted from the second open axial end 10 of the tubular body 7.

The feed duct 16 and the extraction duct 17 are opposite each other and movable coaxially.

The station 15 also comprises first sealing means and first shaping means of the first open end 9 of the tubular body 7, which can be positioned around the first open end 9 of the tubular body 7 and configured overall in such a way as to adapt to the perimeter of the feed duct 16 to create a first hermetically sealed coupling of the first open end 9 of the tubular body 7 on the feed duct 16, and second sealing means and second shaping means of the second open end 10 of the tubular body 7, which can be positioned around the second open end 10 of the tubular body 7 and configured in such a way as to adapt perfectly to the perimeter of the extraction duct 17 to create a second hermetically sealed coupling of the second open end 10 of the tubular body 7 on the extraction duct 17.

The first sealing means comprise two opposite sealing elements 18, 18 having axes of oscillation 19, 19 oriented at right angles to the axis "I" of the capsule 3 and to the axis "m" of the tubular body 7, and similarly the second sealing means comprise two opposite sealing elements 20, 20 having axes of oscillation 21, 21 oriented at right angles to the axis "I" of the capsule 3 and to the axis "m" of the tubular body 7.

The first shaping means comprise two opposite shaping elements 22, 22 having axes of oscillation 23, 23 oriented in the direction of the axis "I" of the capsule 3, and similarly the second shaping means comprise two opposite shaping elements 24, 24 having axes of oscillation 25, 25 oriented in the direction of the axis "I" of the tubular body 3.

The feed duct 16 comprises a feed head 26 substantially combined with that of the first open end 9 of the tubular body 7. More specifically, the head 26 of the feed duct 16 has two grooves or side faces 27, 27 opposite each other inside of which a corresponding one of the first shaping elements 22, 22 slidably engages for making a concertina side fold of the tubular body 7 to facilitate the sealing of the first end 9.

The side grooves 27, 27 have in cross section a "V" shape and the first shaping elements 22, 22 have in turn a shaping head 28, 28 combined with the side grooves 27, 27.

Similarly, the extraction duct 17 comprises an extraction head 29 substantially combined with that of the second open end 10 of the tubular body 7. More specifically, the head 29 of the extraction duct 17 has two grooves or side faces 30, 30 opposite each other inside of which a corresponding one of the first shaping elements 24, 24 slidably engages for making a concertina side fold of the tubular body 7 to facilitate the sealing of the second end 10. The side grooves 30, 30 have in cross section a "V" shape and the second shaping elements 24, 24 have in turn a shaping head 31, 31 combined with the side grooves 30, 30.

Preferably, the feed duct 16 and the extraction duct 17 have an identical shape, and consequently the first shaping elements 22, 22 and the second shaping elements 24, 24 also have the same configuration.

In use, the automatic continuous packaging of the capsules 3 occurs in the following manner.

A first transfer wheel picks up in succession the capsules 3 from the feed station and carries them to the station for cutting to size the sheets 6, wherein the latter are cut and rested on the capsules 3. During this step, the grippers of the first transfer wheel directly grip the capsules 3 at the first diametrically opposite gripping zones of the side wall 5.

The capsules 3 on which the sheets 6 are positioned then reach the wrapping station where the sheets 6 are wrapped tightly around the capsules 3 to form the tubular bodies 7 which are then closed longitudinally by sealing their longitudinal flaps with which the outside tab 8 is formed which is lastly folded against the tubular body 7.

The station 15 is served by a second transfer wheel 13.

Figure 10:
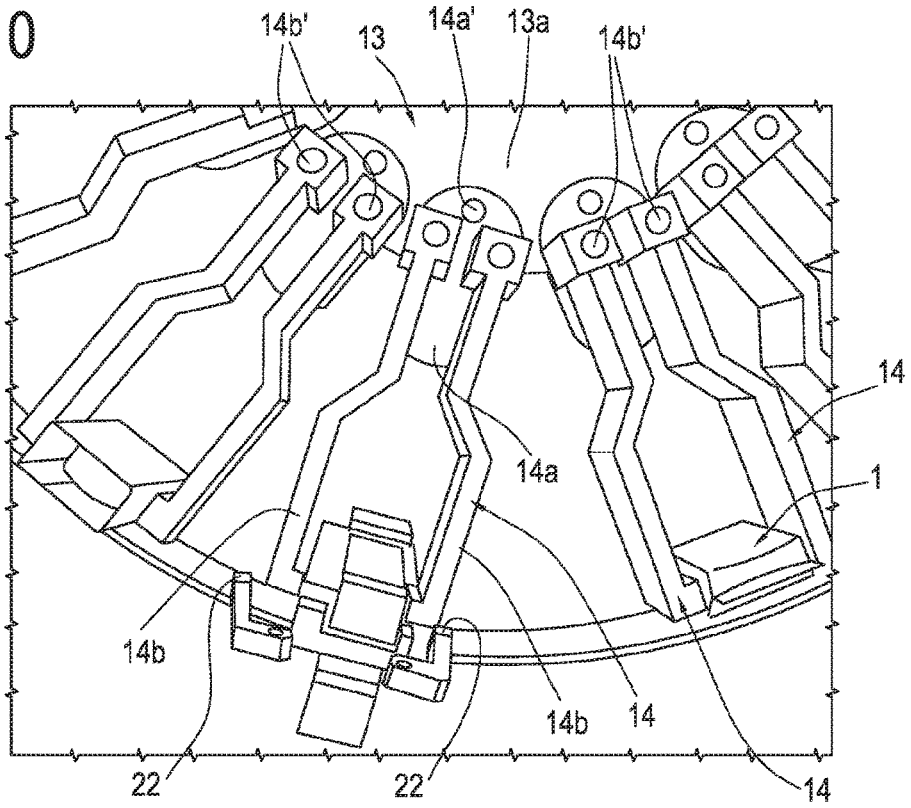
FIG. 10 shows another view of the integrated station and of the transfer wheel from which is served.

It should be noted, with particular reference to FIG. 10, that in the transfer wheel 13 each jaw 14 comprises an arm 14*a* with two fingers 14*b*, 14*b* wherein each finger 14*b*, 14*b* is hinged at 14*b*' to the arm 14*a* and the arm 14*a* is in turn hinged at 14*a*' to the rotary body 13*a* of the transfer wheel 13. The axes of oscillation 14*a*', 14*b*', 14*b*' of the arm 14*a* and of the fingers 14*b*, 14*b* are parallel to the axis of rotation on itself of the body 13*a* of the transfer wheel 13.

More specifically, the arm 14*a* extends radially outwards from the perimeter of the rotary body 13*a* and has the axis of oscillation 14*a* in a peripheral position on the rotary body 13*a*, whilst the axes of oscillation 14*b*', 14*b* are at the same radial distance from the axis of oscillation 14*a*' of the arm 14*a* and on the opposite side relative to the extension of the radius which joins the axis of rotation of the rotary body 13*a* with the axis of oscillation 14*a*' of the arm 14*a*.

In this way it is possible to operate the transfer wheels 13 with a continuous rotary movement, whilst the pieces are stopped temporarily in the process position at the various stations. The stoppage is obtained by retaining at the various stations the grippers 14 which in this way drive their arm 14*a* in a oscillation with an opposite direction to the rotation of the rotary body 13*a* of the wheel 13.

For the transfer of the capsules 3 to the station 15 the grippers of the first transfer wheel are withdrawn from the open ends of the tubular bodies 7, and the grippers 14 of the second transfer wheel 13 grip the tubular bodies 7 at second diametrically opposite gripping zones of the side wall 5 offset from the first gripping zones by an angle of 90° about the axis "I" of the capsules 3.

The second transfer wheel 13 places the tubular body 7 with inside it the capsule 3 in a process position in which the end 9 is aligned with the feed duct 16 which in turn is initially in a home position such that it does not interfere with the trajectory followed by the tubular body 7 for achieving the process position, and the end 10 is aligned with the extraction duct 17 which in turn is in a home position such that it does not interfere with the trajectory followed by the tubular body 7 for achieving the process position.

During this step, the first sealing elements 18, 18 and the second sealing elements 20, 20 are also in a home position such that they do not interfere with the trajectory followed by the tubular body 7 for achieving the process position, and similarly the first shaping elements 22, 22 and the second shaping elements 24, 24 are also in a home position such that they do not interfere with the trajectory followed by the tubular body 7 for achieving the process position.

After the tubular body 7 with the capsule 3 inside it reaches the process position, the head of the feed duct 16 is made to translate to introduce itself in the end 9 of the tubular body 7, the first elements sealing 18, 18 and the first shaping elements 22, 22 clamp the outer perimeter of the end 9 of the tubular body 7 against the outer perimeter of the head of the feed duct 16 with which the end 9 of the tubular body 7 consequently shapes itself, and similarly, the head of the extraction duct 17 is made to translate to introduce itself in the end 10 of the tubular body 7, the second sealing elements 20, 20 and the second shaping elements 24, 24 clamp the outer perimeter of the end 10 of the tubular body 7 against the outer perimeter of the head of the extraction duct 17 with which the end 10 of the tubular body 7 consequently shapes itself.

In this way the hermetic seal is created both of the first open end 9 of the tubular body 7 on the feed duct 16 and on the second open end 10 of the tubular body 7 on the extraction duct 17.

At this point the dispensing of the gas is activated and at the same time the extraction of the air, and at the end of the emptying of the tubular body 7 of the air and its filling with the gas the feed duct 16 is withdrawn from the first end 9 of the tubular body 7 and the extraction duct 17 is withdrawn from the second end 10 of the tubular body 7.

During the slipping out of the feed duct 16 from the first end 9 of the tubular body 7 and of the extraction duct 17 from the second end 10 of the tubular body 7, the first shaping elements 22, 22 remain engaged in the opposite side grooves 27, 27 and the second shaping elements 24, 24 remain engaged in the opposite side grooves 30, 30.

In other words, the feed duct 16 and the extraction duct 17 move by translation from a non-operating first position, where they are outside the respective ends 9, 10, to an operating second position at which they are inserted in the respective ends 9, 10, and vice versa.

More specifically, the first shaping elements 22, 22 and respectively the second shaping elements 24, 24 engage in the opposite side grooves 27, 27 present on the head 26 of the feed duct 16 and, respectively, in the opposite side grooves 30, 30 present on the head 29 of the extraction duct 17 in such a way as to make three opposite side folds 32, 32, 32 on the first end 9 of the tubular body 7 and, respectively, three opposite side folds 33, 33, 33 on a second end 10 of the tubular body 7.

The first sealing elements 18, 18 are moved towards each other starting the folding of the end 9 of the tubular body 7 as soon as the head 26 of the feed duct 16 leaves their movement trajectory, and similarly the second sealing elements 20, 20 are moved towards each other starting the folding of the end 10 of the tubular body 7 as soon as the head 29 of the extraction duct 17 leaves their movement trajectory.

The first shaping elements 22, 22 and the second shaping elements 24, 24 disengage from the ends 9, 10 of the tubular body 7 during the completion of the bending started by the sealing elements 18, 18, 20, 20 and the start of the sealing.

This invention relates to a method for automatic continuous packaging of single-use capsules or pods for portioned beverages comprising the steps of conveying the capsules or pods 3 and respective single or multi-ply flexible sheets 6 in sequence through various operating stations.

Advantageously, the method comprises a step of shaping 15 a flexible sheet 6 about at least one capsule or pod 3 to copy at least in part the shape of the capsule or pod 3.

The method comprises a step of feeding inert gas in a first end 9 of the flexible sheet 6 wrapped around the at least one capsule or pod 3 and a step of sucking air from a second end 10 of the flexible sheet 6 wrapped around the at least one capsule or pod 3.

Advantageously, the above-mentioned shaping step is performed during the steps of feeding inert gas into the first end 9 and extracting air from the second end 10.

The pack, the machine and the method for packaging capsules or pods for portioned beverage as described above can be modified and adapted in several ways without thereby departing from the scope of the inventive concept. Moreover, all the details may be substituted for technically equivalent elements.

In practice the materials and dimensions used can be any, depending on requirements and on the state of the art.

The invention claimed is:

1. A pack, comprising:

a capsule or pod, the capsule or pod being single use, the capsule or pod including two bases opposite one another and a side wall connecting the two bases and delimiting therewith a chamber containing an aromatic substance, and a sealed container containing the capsule or pod housed in a protective atmosphere of inert gas;

wherein the sealed container copies at least in part a shape of the capsule or pod and is in contact with at least part of the capsule or pod to reproduce at least partially the shape;

wherein the sealed container is in contact with at least part of the side wall to at least partly reproduce the shape of the side wall.

2. The pack according to claim 1, wherein the sealed container defines a tubular body having a longitudinal axis and the capsule or pod is positioned in the sealed container with a relative axis oriented at a right angle to the longitudinal axis.

3. The pack according to claim 2, wherein the sealed container is in contact with at least part of at least one of the two bases.

4. The pack according to claim 3, wherein the sealed container is in contact with both of the two bases.

5. The pack according to claim 4, wherein the sealed container is in contact with an entire outside surface of at least one of the two bases.

6. The pack according to claim 5, wherein the sealed container surrounds the capsule or pod.

7. The pack according to claim 1, wherein the sealed container is in contact with at least part of at least one of the two bases.

8. The pack according to claim 7, wherein the sealed container is in contact with both of the two bases.

9. The pack according to claim 8, wherein the sealed container is in contact with an entire outside surface of at least one of the two bases.

10. The pack according to claim 9, wherein the sealed container surrounds the capsule or pod.

11. The pack according to claim 1, wherein the sealed container is in contact with both of the two bases.

12. The pack according to claim 1, wherein the sealed container is in contact with an entire outside surface of at least one of the two bases.

13. The pack according to claim 1, wherein the sealed container surrounds the capsule or pod.

14. The pack according to claim 1, wherein both of the at least part of the sidewall with which the sealed container is in contact with and the portion of the sealed container in contact with the at least part of the sidewall have a matching convex shape.

15. A method for automatically and continuously packaging single-use capsules or pods comprising:

providing a capsule or pod, the capsule or pod being single use, the capsule or pod including two bases opposite one another and a side wall connecting the two bases and delimiting therewith a chamber containing an aromatic substance, and providing a sealed container containing the capsule or pod housed in a protective atmosphere of inert gas;

providing that the sealed container copies at least in part a shape of the capsule or pod and is in contact with at least part of the capsule or pod to reproduce at least partially the shape;

providing that the sealed container is in contact with at least part of the side wall to at least partly reproduce the shape of the side wall;

conveying the capsule or pod and a flexible sheet in sequence through different operating stations, shaping the flexible sheet around the capsule or pod to at least partly copy the shape of the capsule or pod and to at least partly form the sealed container.

16. The method according to claim 15, and further comprising feeding the inert gas into a first end of the flexible sheet wrapped around the capsule or pod.

17. The method according to claim 16, wherein the shaping is performed during the feeding the inert gas into the first end and extracting air from the second end.

18. The method according to claim 15, and further comprising extracting air from a second end of the flexible sheet wrapped around the at least one capsule or pod.

19. The method according to claim 15, and further comprising providing that both of the at least part of the sidewall with which the sealed container is in contact with and the portion of the sealed container in contact with the at least part of the sidewall have a matching convex shape.

* * * * *